US005694098A

United States Patent [19]

Mody et al.

[11] Patent Number: 5,694,098

[45] Date of Patent: Dec. 2, 1997

[54] RATE OF CURRENT RISE SENSITIVE SLOT MOTOR AND SWITCHING APPARATUS HAVING CURRENT LIMITING CONTACT ARRANGEMENT INCORPORATING SAID SLOT MOTOR

[75] Inventors: Hemant K. Mody, Brookfield; Mark A. Juds, New Berlin; Peter J. Theisen, West Bend, all of Wis.

[73] Assignee: Eaton Corporation, Cleveland, Ohio

[21] Appl. No.: 650,359

[22] Filed: May 20, 1996

[51] Int. Cl.[6] ..... H01H 75/00

[52] U.S. Cl. ..... 335/16; 335/195; 218/22

[58] Field of Search ..... 335/16, 147, 195; 228/22

[56] References Cited

U.S. PATENT DOCUMENTS

| | | | |
|---|---|---|---|
| 4,470,027 | 9/1984 | Link et al. | 335/16 |
| 4,608,545 | 8/1986 | Kralik | 335/16 |
| 5,301,083 | 4/1994 | Grass et al. . | |

*Primary Examiner*—Lincoln Donovan

*Attorney, Agent, or Firm*—Larry G. Vande Zande

[57] ABSTRACT

A thick solid steel slot motor is disposed adjacent a movable conductor to apply a contact closing force on the conductor, augmenting the contact pressure spring, under steady state current conditions, and to reduce the force under high rate of current rise conditions to enhance dynamic separation of the movable conductor from a stationary conductor, reducing the strength requirement of the contact pressure spring.

24 Claims, 2 Drawing Sheets

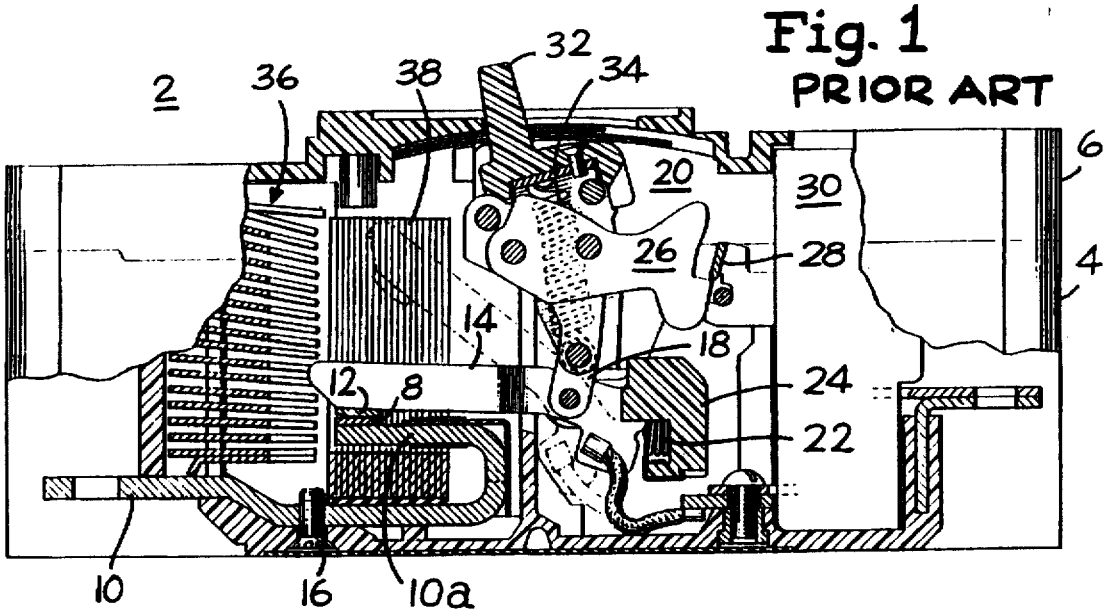
Fig. 1
PRIOR ART
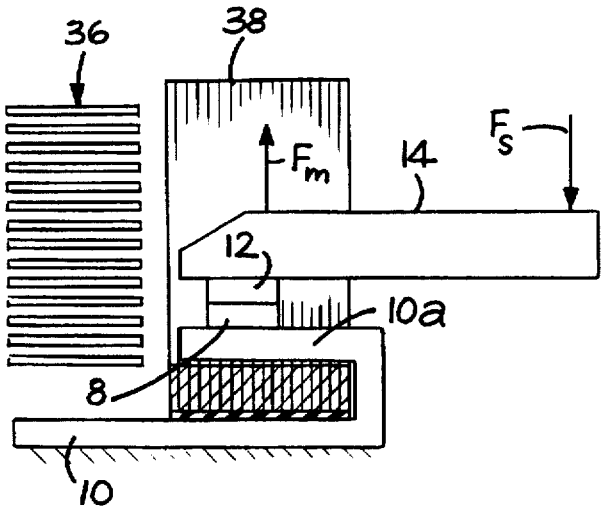
Fig. 2
PRIOR ART
Fig. 3
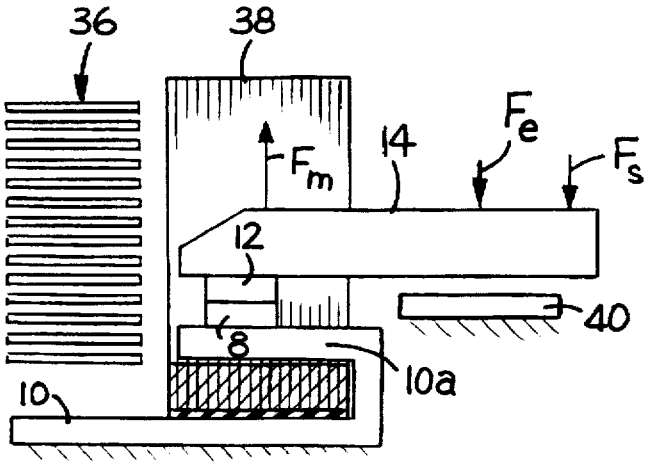

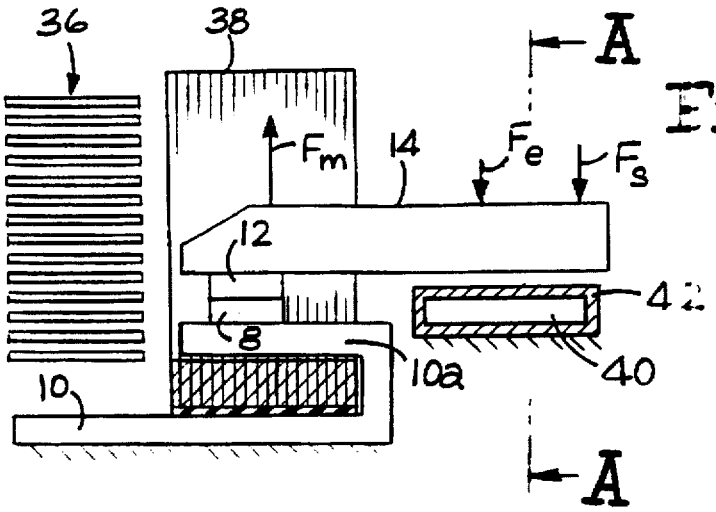
Fig. 4
Fig. 5
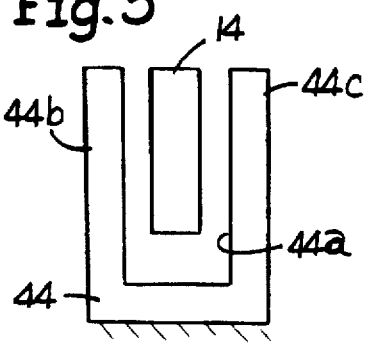
Fig. 6
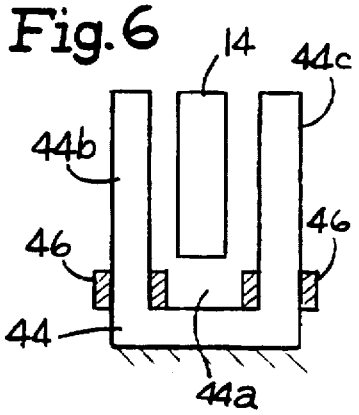
Fig. 7
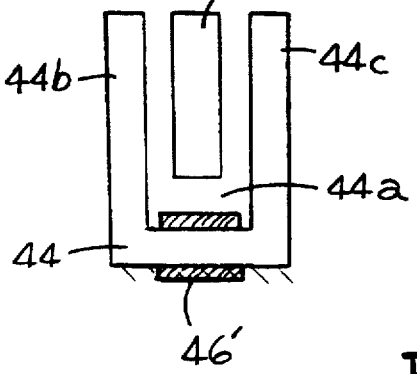
Fig. 8
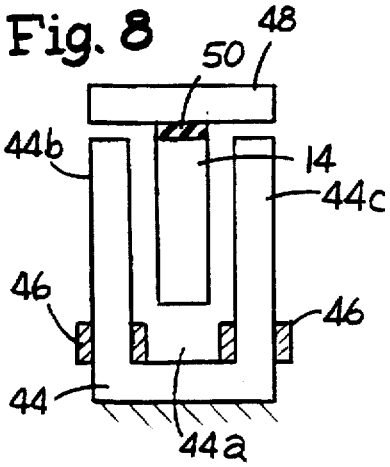
Fig. 9
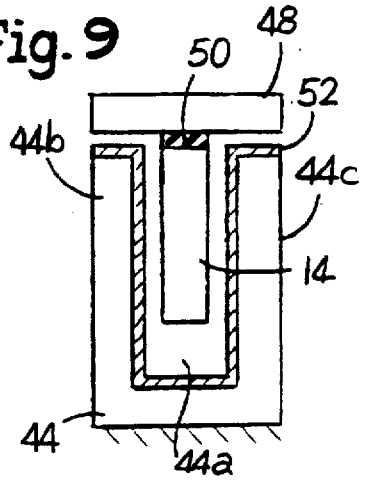

RATE OF CURRENT RISE SENSITIVE SLOT MOTOR AND SWITCHING APPARATUS HAVING CURRENT LIMITING CONTACT ARRANGEMENT INCORPORATING SAID SLOT MOTOR

BACKGROUND OF THE INVENTION

This invention relates to current limiting, contact structures such as are incorporated in overcurrent protective switching apparatus. More particularly, the invention relates to contact structures of the aforementioned type which incorporate a flux concentrator device, commonly known as a slot motor.

In switching apparatus incorporating current limiting contact structures, the separable contacts are commonly arranged to provide a particular length of conductor for providing reversely directed parallel current paths in the two members. As the magnitude of the current increases, the current generates electromagnetic forces which dynamically repel the conductor members. If one conductor is fixed, the repelling magnetic force is directed upon the movable conductor as a blow open force which drives the movable conductor away from the fixed conductor to separate the contacts. In well known embodiments, the magnetic forces are concentrated between the conductors by a magnetic flux concentrator, known as a slot motor, which comprises an O-shaped or a U-shaped magnetic member disposed around the conductors, at least one of which is movable within the slot of the magnetic slot motor in the contact separating direction. The slot motor commonly comprises a plurality of laminations to enhance the flux density by minimizing the eddy currents.

In operation, the current limiting structure responds to the magnitude of currents flowing in the contacts and their conductors to create the magnetic repulsion forces. At currents above a particular threshold value the contacts separate dynamically more quickly than the magnetic trip mechanism of the switching apparatus such as a circuit breaker will respond to fault current conditions. The quick separation limits the peak let-through current passing through the circuit breaker to the protected circuit. The magnetic slot motor is designed to create a contact separating force which exceeds the contact pressure spring force of the circuit breaker mechanism at current magnitudes above peak inrush current. To prevent the contacts from separating or the contact pressure from falling to zero during normal overload or inrush current conditions, the contact pressure spring is typically made stronger, thereby also requiring stronger springs in the operating mechanism of the circuit breaker. This results in increased forces and a requirement for stronger elements throughout the breaker. Moreover, under fault conditions, dynamic separation of the contacts is delayed as the current increases through the inrush threshold to overcome the contact spring pressure, and such delay permits a high $I^2t$ and integral vidt to pass through the breaker to the protected circuit.

SUMMARY OF THE INVENTION

This invention provides a current limiting contact arrangement comprising separable contacts on conductors having reversely directed parallel current paths disposed within a magnetic slot motor and having a second magnetic slot motor disposed adjacent to the movable conductor. The second magnetic slot motor comprises a solid, relatively thick piece of steel which generates a magnetic contact pressure force under steady state current conditions to augment the contact pressure spring force. The second slot motor is made particularly receptive to eddy currents. Under fault conditions, the rate of change of current is high and the force generated by the second slot motor reduces to near zero. With proper geometry and materials, that force may be made to reverse direction. Thus, for steady state current and normal conditions of overload current and inrush current, the second slot motor augments the contact pressure spring, enabling a lighter spring to be used as a contact pressure spring, enabling a lighter springs in the circuit breaker operating mechanism. However, under extreme fault current having a sharp rate of current rise, the force generated by the second slot motor reduces to zero or near zero, or may even reverse, to augment the laminated slot motor in separating the contacts.

The invention, its features and advantages will become more readily apparent when reading the following description and claims in conjunction with the accompanying drawings.

BRIEF DESCRIPTION OF THE DRAWINGS

FIG. 1 is a cross sectional view of a current limiting molded case circuit breaker of conventional, well known design, marked "PRIOR ART";

FIG. 2 is a schematic representation of the current limiting contact arrangement of the molded case circuit breaker of FIG. 1, marked "PRIOR ART";

FIG. 3 is a schematic view of the current limiting contact arrangement of FIG. 2 to which a second slot motor of this invention has been added;

FIG. 4 is a schematic representation of the current limiting contact arrangement of FIG. 3 but showing a modification to the second slot motor;

FIG. 5 is a cross sectional view of a modified embodiment of the second slot motor, the cross section taken generally along a line such as A—A in FIG. 4;

FIG. 6 is a view similar to FIG. 5, but showing another alternate embodiment of the second slot motor wherein shorted turns are provided on the legs of the U-shaped slot motor;

FIG. 7 is a view similar to FIG. 6, but showing another alternate embodiment wherein a shorted turn is provided on the cross leg of the second slot motor;

FIG. 8 is a view similar to FIG. 6 of still another modification comprising the addition of a magnetic armature plate attached to a movable conductor; and FIG. 9 is another modification of the second slot motor wherein a magnetic armature is attached to the movable conductor and the slot of the second slot motor is lined with a layer of good conductivity material for production of increased eddy current values at high rate of changes of the current.

DETAILED DESCRIPTION OF THE PREFERRED EMBODIMENT

Current limiting contact arrangements incorporating magnetic slot motors are commonly employed in molded case circuit breakers 2 such as is shown in FIG. 1. Molded case circuit breaker 2 comprises a molded insulating base 4 having a molded insulating cover 6 attached thereto by screws (not shown). Separable contacts such as fixed contact 8 mounted on a fixed conductor 10 and movable contact 12 mounted on a movable conductor 14 are disposed within the molded case. Stationary conductor 10 is secured to the bottom of base 4 by one or more screws 16. Movable conductor 14 is pivotally mounted within the base 4 and is connected to a collapsible toggle linkage 18 of an operating mechanism 20. A contact pressure spring 22 rests within a pocket of a molded crossbar 24 of the operating mechanism and bears against an offset leg of movable conductor 14 to apply a contact closing force $F_s$ (FIG. 2) on the conductor, biasing movable contact 12 into engagement with stationary contact 8. A latch lever 26 of operating mechanism 20 engages a latch 28 of a trip unit 30 to lock one end of the collapsible toggle linkage 18 in place, whereby selective movement of an operating handle 32 will carry an operating spring 34 across a line of action of the toggle linkage to move conductor 14 and movable contact 12 into and out of engagement with stationary contact 8. Arcs formed by the separating contacts 8 and 12 are directed into an arc chute 36.

Overload currents and short circuits are detected by thermal and magnetic elements, respectively, in the trip unit 30. Upon detection, trip unit 30 releases latch 28 to release latch lever 26, thereby permitting toggle linkage 18 to collapse and drive movable conductor 14 upward to the dotted line position. This separates contacts 8 and 12 and opens the circuit. Under high fault current conditions, the magnetic trip action of a conventional trip unit 30 is deemed to be too slow, and current limiting features are added to the circuit breaker contact arrangement. Such features include making movable conductor 14 movable relative to the operating mechanism such that it may move to the dotted line position while the linkage 18 is locked in position by latch lever 26. Stationary conductor 10 is provided with a turn back portion 10*a* adjacent movable conductor 14 to provide a length of parallel, reverse direction current paths in the two conductors. Finally, a slot motor 38 is provided comprising a stack of thin, U-shaped laminations. The legs of the U-shaped slot motor extend alongside conductors 10*a* and 14 in the area of contacts 8 and 12, and the closed end of the U-shape extends below conductor portion 10*a*. High fault current in the conductors generate magnetic flux patterns which are concentrated by the slot motor and coact with the current to generate repelling forces between the two conductors. The resultant force $F_m$ generated is proportional to the magnitude of the current $I^y$, where y is greater than or equal to 1 and less than or equal to 2, depending upon the degree of saturation of the slot motor. The slot motor is comprised of thin laminations to minimize the effect of eddy currents in the slot motor which could reduce the resultant force $F_m$. Separation of the contacts dynamically due to the slot motor 38 occurs very rapidly, before the trip unit 30 has time to react, and therefore limits the amount of let-through fault current that may pass through the breaker to the load.

Current flow in the conductor 10 and movable conductor 14 generate a magnetic flux in the slot motor 38 which in turn produces a dynamic separating force $F_m$ on the movable conductor 14. The total components of the contact arrangement are designed to maintain contacts 8 and 12 closed during peak inrush currents and normal overload currents. However, a peak inrush current may be as much as twenty times the rated current, and the slot motor 38 will react to electromagnetic flux generated by that current to establish the force $F_m$ in the contact separating direction. The circuit breaker operating mechanism, the slot motor 38, and contact pressure spring 22 are designed whereby the force $F_s$ of the contact pressure spring 22 exceeds the slot motor developed force $F_m$ at peak inrush values to avoid reducing the contact pressure to zero and to prevent nuisance separation of the contacts. However, when a high fault current is present in the contact arrangement, $F_m$ attains a net opening value only after it overcomes the magnitude of $F_s$ which is made stronger to withstand the peak inrush value, thereby creating a delay in initiating the opening movement of conductor 14 under current limiting conditions. This causes a high $I^2t$ and integral vidt passing through the breaker contact arrangement.

This invention provides an improvement to the current limiting contact arrangement such as that described in the foregoing and as shown in FIGS. 1 and 2 by providing a second magnetic slot motor which is responsive to rate of change of the current in the contact arrangement, whereas the slot motor 38 is responsive to the magnitude of the square of the current. The second slot motor (FIG. 3) comprises a solid piece of thick steel 40 fixed adjacent the movable conductor 14 on the same side as that to which contact 12 is fixed. Thick steel is magnetized more readily at a low rate of change of current. Therefore under normal overload conditions or inrush conditions wherein the magnitude of the current increases but the rate of change of the current is relatively low, the current in conductor 14 generates a magnetic flux pattern in second slot motor 40 which generates a force $F_e$ in the same direction as the force $F_s$ of the contact pressure spring 22 to assist the contact pressure spring 22 in maintaining the movable contact 12 closed upon the stationary contact 8. The strength of the contact pressure spring 22 can therefore be reduced as may also be the strength of the operating mechanism spring 34 and the overall strength of the individual elements lowering the cost of the breaker and improving the operating performance. As the rate of rise in the current increases under fault current conditions, the magnitude of force $F_e$ decreases, lowering the level at which force $F_m$ overcomes the closing force $F_e$ and $F_s$ and dynamically separates the contacts 8 and 12.

As stated hereinabove, because the second slot motor 40 is a solid piece of thick steel, it is more readily magnetized at a low rate of change of current, i.e. at a steady state current. Conversely, it is less readily magnetized at a high rate of change of current such as is present under high fault conditions. This is due to the depth of flux penetration in a thick, solid member and to the receptivity of the member to eddy current generation which reduces the magnetic forces generated by the member. The attraction force $F_e$ has been calculated and found to change by as much as a factor of three at a given current level where the rate of change of current corresponds to the difference between inrush and fault current. The force $F_e$ can even be made to reverse direction with the appropriate geometry of the auxiliary slot motor 40 such as by providing a shorted turn 42 as shown in FIG. 4. Here an electrically conductive ring of copper or the like 42 is placed around the steel member 40 to generate eddy current loses in the magnetic flux field and in turn create a force $F_e$ which is directed in the same direction as the slot motor force $F_m$ to assist in opening the contacts.

The second slot motor 40 shown in FIGS. 3 and 4 is a flat plate of steel fixedly positioned under the movable conductor 14. As may be seen in FIG. 5, which is a transverse cross section taken along a line such as A—A in FIG. 4, an alternate embodiment comprises a U-shaped second slot motor 44, also made of a solid piece of thick steel. The movable conductor 14 is disposed in the slot 44*a* between the upstanding legs 44*b* and 44*c*. The U-shaped steel slot motor 44 reduces the length of the flux path (in air) over that flux path of the flat plate 40 of FIGS. 3 and 4, which results in-increased flux and increased eddy currents, the latter being generated in both legs and in the lower cross leg of the U-shaped second slot motor.

To increase the sensitivity to rate of change of current of second slot motor 44, another embodiment is shown in FIG.

6. Electrically conductive shorting rings 46 are provided on each of the upstanding legs 44b and 44c of the U-shaped second slot motor 44 to provide a shorted turn on each of the legs for the generation of still additional eddy currents. In FIG. 7 a single shorting ring 46' is placed on the cross leg of second slot motor 44.

A modification of the FIG. 6 embodiment is shown in FIG. 8. A thick steel armature 48 is attached to the movable conductor 14, but electrically insulated therefrom by an insulator 50. Armature 48 overlies the distal ends of legs 44b and 44c and is spaced therefrom in the closed contact position of the contact arrangement. All of the factors regarding force are the same as described in conjunction with FIG. 6 except that additional forces now are present at the pole faces at the distal ends of the legs. These additional forces are proportional to the square of the flux and the square of the current.

Another modification of the second slot motor 44 is shown in FIG. 9. A thin layer 52 of good conductivity material such as copper is applied along the inner face of each leg 44b and 44c and along the inner face of the bottom cross leg. The copper also extends over the pole faces at the distal ends of the legs 44b and 44c. Eddy currents are directly generated within the copper layer 52, preventing flux from entering the steel slot motor, thereby reducing attraction force $F_e$.

The foregoing has described an improved current limiting contact arrangement incorporating a laminated slot motor and a second, solid steel slot motor which responds to rate of change of current to reduce the contact closing-force as the rate of change of current increases. Several modifications of the second slot motor have been described. It is to be understood that the invention is susceptible of still other modifications without departing from the scope of the appended claims.

We claim:

1. Current limiting switching apparatus comprising:

first and second separable contacts mounted on first and second conductors, respectively;

operating means for effecting movement of at least one of said conductors for selectively effecting closure and separation of said first and second contacts;

spring means providing a closing force on said contacts;

means permitting dynamic separation of said contacts in opposition to said closing force irrelative to operation of said operating means;

a current magnitude sensitive slot motor comprising a plurality of thin laminations arranged in a stack disposed around said first and second contacts and said first and second conductors, said current magnitude sensitive slot motor providing a separating dynamic force on said conductors proportional to the square of the magnitude of current flowing in said contacts; and a rate of current rise sensitive slot motor comprising a thick magnetic member relative to individual ones of said laminations disposed adjacent one of said conductors, said rate of current rise sensitive slot motor providing a closing force on said conductors proportional to the square of the steady state condition of current flowing in said contacts, said slot motor provided closing force decreasing as the rate of current rise increases.

2. The current limiting switching apparatus defined in claim 1 wherein said slot motor provided closing force is additive to said spring means provided closing force to provide a resultant closing force opposing and offsetting said separating dynamic force for predetermined load and inrush current values.

3. The current limiting switching apparatus defined in claim 1 wherein said rate of current rise slot motor is particularly adapted for receptivity of eddy currents.

4. The current limiting switching apparatus defined in claim 3 wherein said rate of current rise slot motor comprises a ring of good electrical conductivity material surrounding said magnetic member.

5. The current limiting switching apparatus defined in claim 1 wherein said rate of current rise slot motor comprises a U-shaped member having legs respectively disposed along opposite sides of said one of said conductors and a closed end disposed on a same side of said one of said conductors as a respective said contact is mounted.

6. The current limiting switching apparatus defined in claim 5 wherein said rate of current rise slot motor comprises a ring of good electrical conductivity material surrounding each said leg.

7. The current limiting switching apparatus defined in claim 6 further comprising a thick magnetic armature member attached to said one of said conductors, said armature member being electrically insulated from said one of said conductors, said armature member overlying distal ends of said legs in spaced apart relation thereto.

8. The current limiting switching apparatus defined in claim 5 comprising a layer of good electrical conductivity material disposed along inner surfaces of said legs and said closed end of said rate of current rise slot motor and along outwardly facing distal end surfaces of said legs, and a thick magnetic armature member attached to said one of said conductors, said armature member being electrically insulated from said one of said conductors, said armature member overlying said outwardly facing distal end surfaces of said legs in spaced apart relation thereto.

9. A current limiting contact arrangement sensitive to rate of rise of current flow in contacts thereof comprising:

a first slot motor comprising a plurality of thin magnetic laminations arranged in a stack and defining a slot therein;

a fixed conductor extending into said slot and having a stationary contact mounted thereto within said slot;

a movable conductor extending into said slot and having a movable contact mounted thereto within said slot;

an operating mechanism operable for moving said movable conductor for selectively effecting closure and separation of said movable contact with said stationary contact;

contact pressure spring means co-acting between said movable conductor and said operating mechanism for biasing said movable contact against said stationary contact in a closed position of said contacts;

said first slot motor cooperating with current flow in said conductors and said contacts for providing a contact separating force on said movable conductor in proportion to the square of the magnitude of said current flow; and a second slot motor comprising a magnetic member disposed adjacent said movable conductor, said second slot motor providing a contact closing force on said movable conductor in proportion to the square of a steady state magnitude of said current flow, and being responsive to a rising current flow for decreasing said closing force as said rate of current rise increases.

10. The current limiting contact arrangement defined in claim 9 wherein said second slot motor is adapted to be particularly receptive to eddy currents.

11. The current limiting contact arrangement deemed in claim 10 wherein said second slot motor comprises a thick magnetic member relative to said laminations of said first slot motor.

12. The current limiting contact arrangement defined in claim 11 wherein said second slot motor comprises a ring of good electrical conductivity material surrounding said magnetic member.

13. The current limiting contact arrangement defined in claim 10 wherein said second slot motor comprises a thick U-shaped magnetic member, a closed end of said member being disposed adjacent said movable conductor at a side of which said movable contact is mounted, and legs of said U-shaped magnetic member extending along opposite sides of said movable conductor in a direction of separating movement of said movable conductor.

14. The current limiting contact arrangement defined in claim 13 wherein said second slot motor comprises a ring of good electrical conductivity material disposed around each of said legs of said U-shaped magnetic member.

15. The current limiting contact arrangement defined in claim 13 further comprising a thick magnetic armature member attached to said movable conductor and electrically insulated therefrom, said armature member overlying distal ends of said legs of said U-shaped member in spaced apart relation to said distal ends when said movable conductor is in a closed contact position.

16. The current limiting contact arrangement defined in claim 15 wherein said second slot motor comprises a ring of good electrical conductivity material disposed around each of said legs of said U-shaped magnetic member.

17. The current limiting contact arrangement defined in claim 15 further comprising a layer of good electrical conductivity material disposed along inner surfaces of said closed end and said legs of said U-shaped magnetic member.

18. The current limiting contact arrangement defined in claim 17 wherein said layer of good electrical conductivity material extends over faces of said distal ends of said legs.

19. A method of separating contacts to limit let-through current comprising:

arranging first and second conductors having respective mating contacts in parallel relation with said contacts engaged;

directing current flow in opposite directions in said conductors, applying a spring force on said conductors to bias said mating contacts together;

positioning a laminated magnetic slot motor around said first and second conductors for providing a dynamic separating force on said conductors in proportion to the square of the magnitude of said current flowing in said conductors; and positioning a second slot motor adjacent one of said first and second conductors on a side thereof containing a respective said contact, said second slot motor comprising a solid member of thick magnetic material for applying a closing magnetic force on said contacts under substantially steady state conditions of said current, and reducing said closing magnetic force in proportion to a rate of change of said current under rising fault current conditions.

20. The method of separating contacts to limit let-through current defined in claim 19 further comprising the step of enhancing receptivity of said second slot motor to eddy currents by forming good electric conductivity material on said second slot motor.

21. The method of separating contacts to limit let-through current defined in claim 19 comprising forming said second slot motor as a U-shaped member and positioning spaced legs of said second slot motor alongside said separable contacts extending in a direction of separating movement thereof.

22. The method of separating contacts to limit let-through current defined in claim 21 comprising the step of positioning rings of good electric conductivity material around each of said legs.

23. The method of separating contacts to limit let-through current deemed in claim 22 comprising affixing a magnetic armature to one of said conductors and positioning said armature to overlie distal ends of said legs.

24. The method of separating contacts to limit let-through current defined in claim 21 by affixing a layer of good electric conductivity material along inner surfaces of said U-shaped second slot motor legs and over surfaces on distal ends of said spaced legs.

* * * * *